US005607132A

United States Patent [19]

Baldwin

[11] Patent Number: 5,607,132

[45] Date of Patent: Mar. 4, 1997

[54] PEGBOARD HANGER

[76] Inventor: Henry E. Baldwin, 77190 Lauppe La., Citrus Heights, La. 95621

[21] Appl. No.: 489,669

[22] Filed: Jun. 12, 1995

[51] Int. Cl.[6] ..... A47B 96/06

[52] U.S. Cl. ..... 248/220.42; 248/303; D8/370

[58] Field of Search ..... 248/220.41, 220.42, 248/220.43, 222.11, 222.12, 303, 304; 211/59.1, 57.1, 106; D8/370, 367, 354

[56] References Cited

U.S. PATENT DOCUMENTS

| | | | |
|---|---|---|---|
| 383,983 | 6/1888 | Phillips et al. | 248/303 |
| 3,069,122 | 12/1962 | Babajoff | 248/220.43 |
| 3,154,281 | 10/1964 | Frank | 248/220.31 X |
| 3,211,293 | 10/1965 | Tarnoff | 248/220.31 |
| 3,288,414 | 11/1966 | Fortunato | 248/222.12 |
| 3,289,993 | 12/1966 | Thalenfeld | 248/220.41 |
| 3,392,949 | 7/1968 | Meyer, Jr. | 248/220.42 |
| 4,394,909 | 7/1983 | Valiulis et al. | 248/220.31 X |
| 4,645,154 | 2/1987 | Bly | 248/220.41 X |
| 5,180,128 | 1/1993 | Massey | 248/220.41 |
| 5,346,167 | 9/1994 | Smialek | 248/220.43 |
| 5,407,160 | 4/1995 | Hollingsworth et al. | 248/220.43 |

*Primary Examiner*—Korie Chan

[57] ABSTRACT

A hanger for suspending an object relative to a pegboard. The inventive device includes a mounting assembly for securing to a pegboard which includes a plurality of securing pegs comprising a bifurcated projection with each furcation thereof terminating in a truncated semi-conical head. An engaging assembly extends from the mounting assembly for suspending an object therefrom to support the object relative to a pegboard.

1 Claim, 3 Drawing Sheets

PEGBOARD HANGER

BACKGROUND OF THE INVENTION

1. Field of the Invention

The present invention relates to hanging devices and more particularly pertains to a pegboard hanger for suspending an object relative to a pegboard.

2. Description of the Prior Art

The hanging devices is known in the prior art. More specifically, hanging devices heretofore devised an utilized are known to consist basically of familiar, expected and obvious structural configurations, notwithstanding the myriad of designs encompassed by the crowded prior art which have been developed for the fulfillment of countless objectives and requirements.

Known prior art hanging devices include U.S. Pat. No. 5,180,128; U.S. Pat. No. 5,054,728; U.S. Pat. No. 4,681,233; U.S. Pat. No. 4,616,753, U.S. Pat. No. Des. 255,324; and U.S. Pat. No. Des. 322,047.

While these devices fulfill their respective, particular objectives and requirements, the aforementioned patents do not disclose a pegboard hanger for suspending an object relative to a pegboard which includes a mounting assembly for securing to a pegboard having a plurality of securing pegs each compirsing a bifurcated projection with each furcation thereof terminating in a truncated semi-conical head, and an engaging assembly extending from the mounting assembly for suspending an object therefrom to support the object relative to a pegboard.

In these respects, the pegboard hanger according to the present invention substantially departs from the conventional concepts and designs of the prior art, and in so doing provides an apparatus primarily developed for the purpose of suspending an object relative to a pegboard.

SUMMARY OF THE INVENTION

In view of the foregoing disadvantages inherent in the known types of hanging devices now present in the prior art, the present invention provides a new pegboard hanger construction wherein the same can be utilized for suspending an object relative to a pegboard. As such, the general purpose of the present invention, which will be described subsequently in greater detail, is to provide a new pegboard hanger apparatus and method which has many of the advantages of the hanging devices mentioned heretofore and many novel features that result in a pegboard hanger which is not anticipated, rendered obvious, suggested, or even implied by any of the prior art hanging devices, either alone or in any combination thereof.

To attain this, the present invention generally comprises a hanger for suspending an object relative to a pegboard. The inventive device includes a mounting assembly for securing to a pegbaord which includes a plurality of securing pegs each comprising a bifurcated projection with each furcation thereof terminating in a truncated semi-conical head. An engaging assembly extends from the mounting assembly for suspending an object therefrom to support the object relative to a pegboard.

There has thus been outlined, rather broadly, the more important features of the invention in order that the detailed description thereof that follows may be better understood, and in order that the present invention contribution to the art may be better appreciated. There are additional features of the invention that will be described hereinafter and which will form the subject matter of the claims appended hereto In this respect, before explaining at least one embodiment of the invention in detail, it is to be understood that the invention is not limited in its applicated to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new pegboard hanger apparatus and method which has many advantages of the hanging devices mentioned heretobore and many novel features that result in a pegboard hanger which is not anticipated, rendered obvious, suggested, or even implied by any of the prior art tool guides, either alone or in any combination thereof.

It is another object of the present invention to provide a new pegboard hanger which may be easily and efficiently manufactured and marketed.

It is a further object of the present invention to provide a new pegboard hanger which is of a durable and reliable construction.

An even further object of the present invention is to provide a new pegboard hanger which is susceptible of a low cost of manufacture with regard to both materials and labor, and which accordingly is then susceptible of low prices of sale to the consuming public, thereby making such pegboard hangers economically available to the buying public.

Still yet anotehr object of the present invention is to provide a new pegbaord hanger which provides in the apparatuses and methods of the prior art some of the advantages thereof, while simultaneously overcoming some of the disadvantages normally associated therewith.

Still another object of the present invention is to provide a new pegboard hanger for suspending an object relative to a pegboard.

Yet another object of the present invention is to provide a new pegboard hanger which includes a mounting assembly for securing to a pegboard having a plurality of securing pegs each comprising a bifurcated projection with each furcation thereof terminating in a truncated semi-conical head, and an engaging assembly extending from the mounting assembly for suspending an object therefrom to support the object relative to a pegboard.

These together with other objects of the invention, along with various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
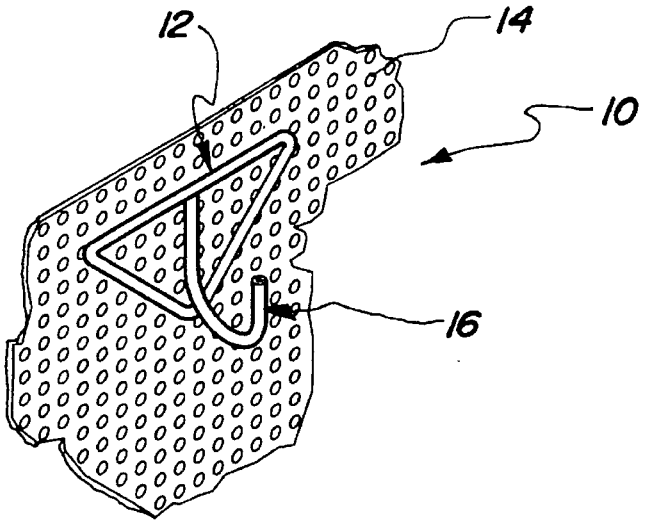
FIG. 1 is an isometric illustration of a pegboard hanger according to the present invention in use.

With reference now to the drawings, and in particular to FIGS. 1–7 thereof, a pegboard hanger embodying the principles and concepts of the present invention and generally designated by the reference numeral 10 will be described.

More specifically, it will be noted that the pegboard hanger 10 comprises a mounting means 12 for securing to a pegboard 14 commonly secured in a vertical orientation to a vertical wall surface within a storage area or the like, as shown in FIG. 1 of the drawings. The pegboard 14 is shaped so as to define a plurality of through-extending apertures arranged in a matrix of aligned rows and columns equally spaced from one another. An engaging means 16 is coupled to the mounting means 12 and projects outwardly therefrom so as to support an object relative to the pegboard 14 during the use of the device 10. By this structure, the mounting means 12 can be selectively engaged to one or more of the apertures in the pegboard 14, with an object being hung from the engaging means 16 as desired.

Figure 2:
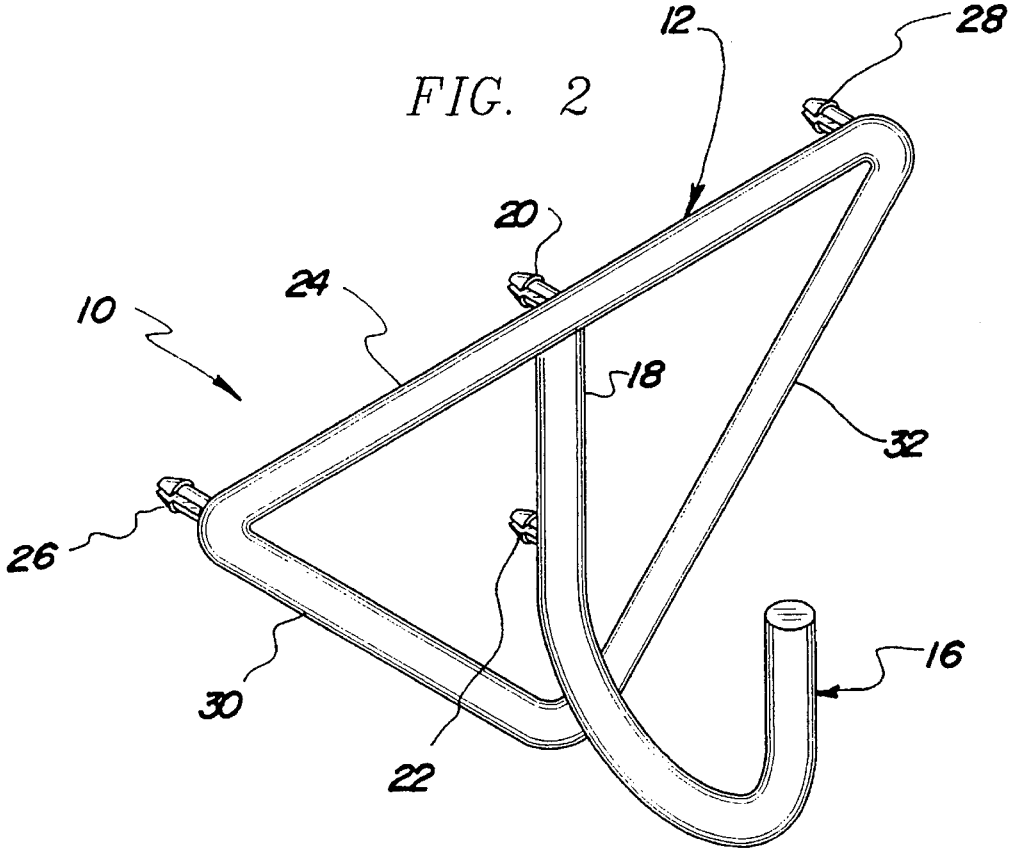
FIG. 2 is an isometric illustration of the invention, per se.

Referring now to FIG.2, it can be shown that the mounting means 12 according to the present invention 10 preferably comprises a depending center member 18 having an upper end spaced from a lower end, with the engaging means 16 projecting from a lower end of the depending center member. A center securing peg 20 is secured to an upper end of the depending center member 18 and adpated for removable positioning through one of the apertures in the pegboard 14. A lower securing peg 22 is secured to a lower end of the depending center member 18 proximal to a juncture of the depending center member and the engaging means 16 and is adapted for securement or positioning through one of the apertures of the pegboard 14. By this structure, the mounting means 12 can be frictionally or otherwise mechanically engaged to one or more of the apertures in the pegboard 14 so as to retain the engaging means 16 in a desired oreintation relative thereto.

To impart lateral stability to the mounting means 12, the mounting means preferably further comprises a transverse member 24 fixedly secured to an upper end of the depending center member 18 and oriented so as to extend substantially orthogonally in opposite directions therefrom. In other words, the depending center member 18 is preferably secured to a center of the transverse member 24 such that opposed halves of the transverse member 24 project in opposite directions relative to the depending center member 18. A first lateral securing peg 26 is secured to a first end of the transverse member 24 and adapted for positioning through one of the apertures in the pegboard 14. Similarly, a second lateral securing peg 28 is secured to a second end of the transverse member 24 and also adapted for removable positioning through one of the apertures in the pegboard 14. By this structure, rotation of the depending center member 18 about a longitudinal axis thereof as a result of forces applied to the engaging means 16 is substantially reduced inasmuch as the transverse member 24 operates to engage the pegboard 14 to preclude such rotation.

With continuing reference to FIG. 2, it can be shown that the mounting means 12 may further comprise a depending brace comprising a first lower angle brace 30 projecting from the first end of the transverse member 24 and oriented at an oblique angle relative thereto. A second lower angled brace 32 similarly projects from the second end of the transverse member 24 and is oriented so as to extend at an oblique angle relative thereto. The lower angled braces 30 and 32 project towards one another and are secured together at a point substantially aligned with a longitudinal axis of the depending center member 18. By this structure, the depending lower brace serves to engage the pegboard 14 to further resist movement of the mounting means 12 as a result of forces applied to the engaging means 16 during use of the device 10. Preferably, the center member 18, the transverse member 24, and the lower angled braces 30 and 32 all reside within a common plane.

Figure 3:
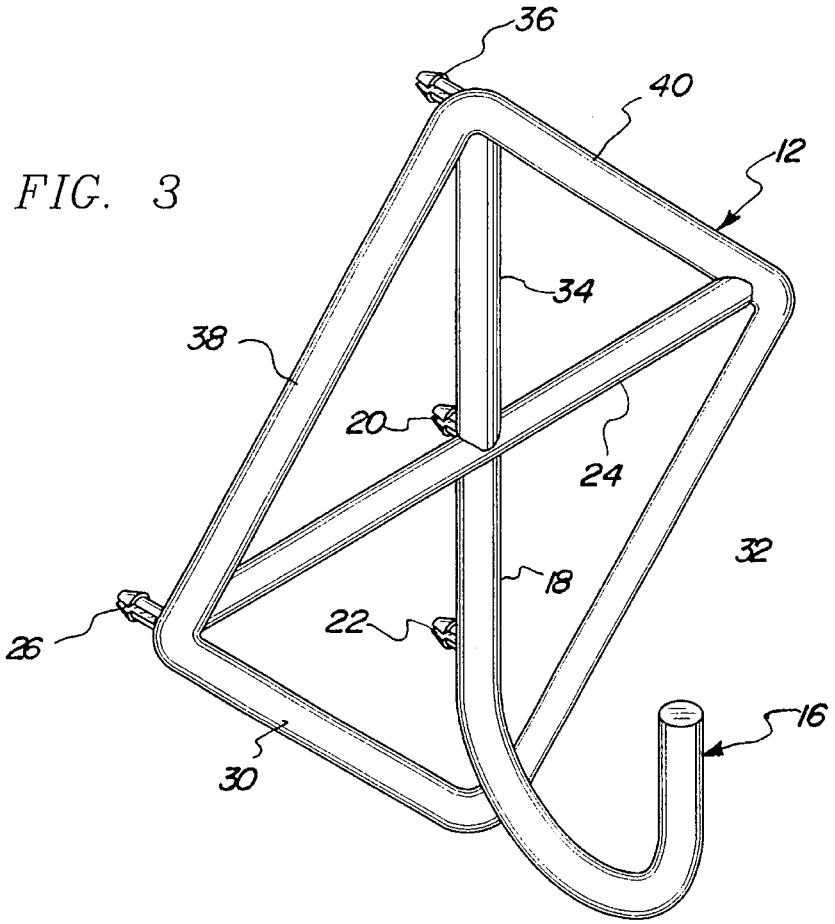
FIG. 3 is an isometric illustration of an alternative form of the present invention.
Figure 4:
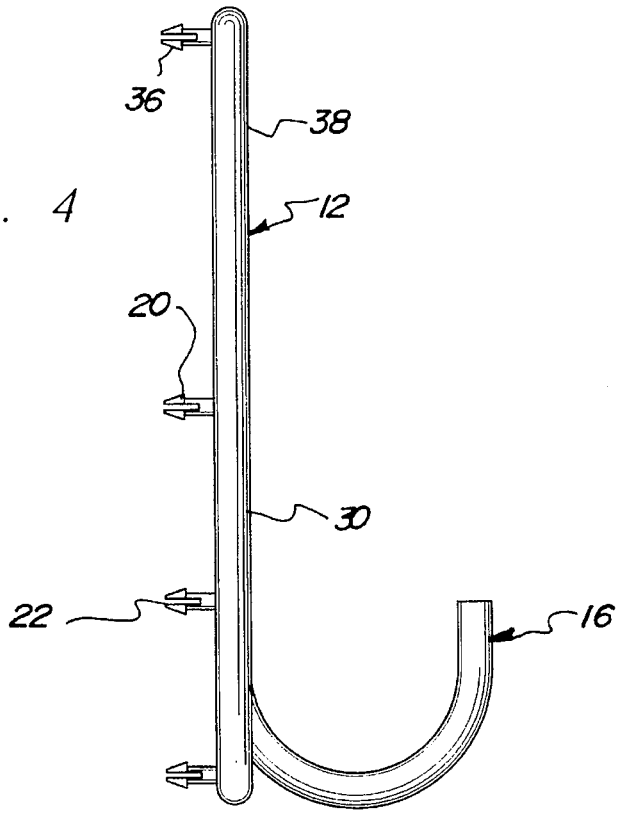
FIG. 4 is a side elevation view of the alternative form illustrated in FIG. 3.

Referring now to FIGS. 3 and 4 of the drawings wherein an alternative form of the present invention is illustrated in detail, it can be shown that the mounting means 12 may further comprise a center stanchion 34 projecting upwardly from the transverse member 24 in a direction oppoistie that of the depending center member 18. An upper securing peg 36 is secured to an upper end of the center stanchion 34 and is adapted for positioning through one of the apertures in the pegboard 14. To impart further structural rigidity to the center stanchion 34 and the upper securing peg 36 attached thereto, the mounting means 12 may further comprise an upper brace extending between the transverse member 24 and the upper end of the center stanchion 34. To this end, the upper brace preferably comprises a first upper angled brace 38 projecting from the first end of the transverse member 24 and being secured to the upper end of the center stanchion 34. Similarly, a second upper angled brace 40 projects from the second end of the transverse member 24 at an oblique angle relative thereto and is coupled to the upper end of the center stanchion 34. Preferably, the transverse member 24 and the angled braces 30, 32, 38, and 40 all reside within a common plane.

As best illustrated in the side elevation view of FIG. 4, it can be shown that each of the securing pegs 20, 22, 26, 28, and 36 preferably comprises a bifurcated projection extending substantially orthogonally from the respective portion of the mounting means 12. The bifurcated projection thus inherently defines spaced furcations which can be resiliently biased together. Each of the furcations terminates in a truncated semi-conical head. The truncated semi-conical heads are positioned in a facing relationship kso as to define a split cone which can be resiliently biased together during insertion of the respective peg through a hole in the pegboard 14. Preferably a major diameter of the peg 20 defined as a distance between outer most portions of the semi-conical heads is substantially greater than a diameter of the holes extending through the pegboard 14. By this structure, the semi-conical heads of the respective pegs can be resiliently biased together during insertion thereof through the holes in the pegboard 14, whereby after a complete passage of the semi-conical heads through the holes in the pegboard 14, the bifurcated projection will resiliently expand so as to retain the pegs in a mechanical engagement with the pegboard 14. To this end, it is desirable that the semi-conical heads be spaced at least a distance from the respective portions of the mounting means 12 equal to or greater than a thickness of the pegboard 14.

Figure 5:
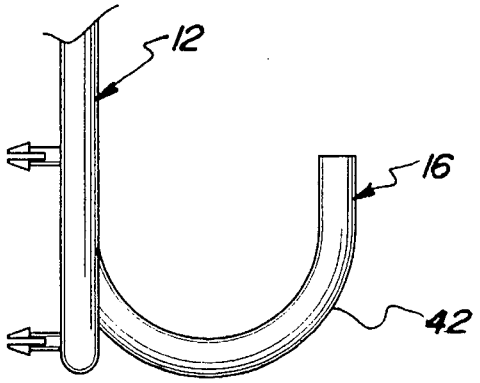
FIG. 5 is a side elevation of an engaging means comprising a portion of the present invention.
Figure 6:
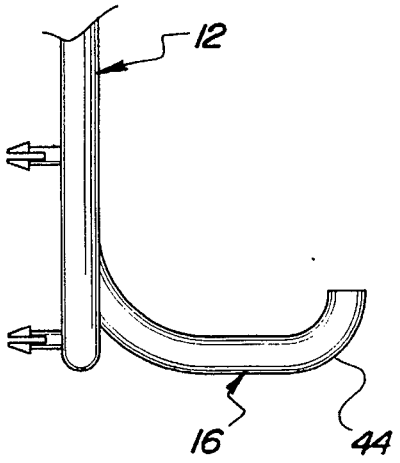
FIG. 6 is a side elevation view of an alternative form of the engaging means.
Figure 7:
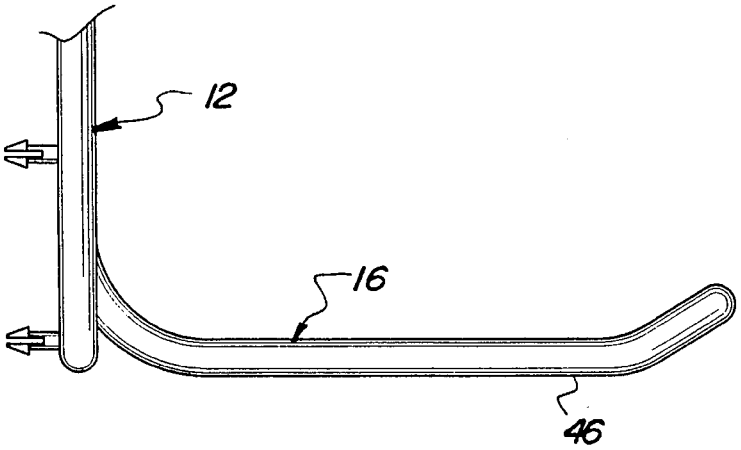
FIG. 7 is a side elevation view of an further alternative form of the engaging means.

Referring now to FIGS. 5 through 7, it can be shown that the engaging means 16 of the present invention 10 preferably comprises a hook 42 integrally or otherwise fixedly secured to a lower end of the depending center member 18 and projecting out of a plan containing the center member. As shown in FIG. 6, the engaging means 16 may alternatively comprise a truncated hanger 44 which is integrally or otherwise fixedly secured to the lower end of the depending center member 18. Further, and as shown in FIG. 7, the engaging means 16 may further alternatively comprise an elongated hanger 46 secured to the lower end of the depending center member 18. The various forms of the engaging means 16 permit a variety of objects to be hung from the engaging means as desired by an end user.

In use, the pegboard hanger 10 according to the present invention can be easily utilized to support an objective relative to a pegboard 14 when the mounting means 12 is engaged relative thereto. The present invention 10 permits ease of securement of the mounting means 12 relative to the pegboard 14 without requiring a pivoting of the mounting means out of a plane parallel to a plane containing the pegboard.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed by the present invention.

Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pegboard hanger comprising:

a mounting means for securing to at least one aperture of a pegboard, the mounting means comprises a depending center member having an upper end spaced from a lower end, a center securing peg secured to the upper end of the depending center member and adapted for removable positioning through an aperture of the pegboard, a lower securing peg secured to the lower end of the depending center member and adapted for removable positioning through an aperture of the pegboard, the mounting means further comprises a transverse member fixedly secured to the upper end of the depending center member and oreinted so as to extend substantially orthogonally in oppostie directions therefrom, a first lateral securing peg secured to a first end of the transverse member and adapted for removable positioning through an aperture in the pegboard, a second lateral securing peg secured to a second end of the transverse member and adapted for removable positioning through an aperture in the pegboard, the mounting means further comprises a depending brace comprising a first lower angled brace projecting from the first end of the transverse member and oriented at an oblique angle relative thereto, a second lower angled brace projecting from the second end of the transverse member and oriented so as to extend in an oblique angle relative thereto, the lower angled braces projecting towards one another and being relative thereto, the lower angled braces projecting towards one another and being secured together at a point susbtantially aligned with a longituinal axis of the depending center member, the mounting means further comprises a center stanchion projecting upwardly from the transverse member in a direction opposite that of the depending center member, an upper securing peg secured to an upper end of the center stanchion and adapted for positioning through an aperture in the pegboard, the mounting means further comprises an upper brace extending between the transverse member and the upper end of the center stanchion, the upper brace comprising a first uper angled brace projecting from the first end of the transverse member and being secured to the upper end of the center stanchion, a second upper angled brace projecting from the second end of the transverse member at an oblique angle relative theteto and being coupled to the upper end of the center stanchion, with the transverse member and the angled braces all residing within a common plane, each of the securing pegs comprises a bifurcated projection extending substantially orthogoanlly from the mounting means, the bifurcated projection defining spaced furcations which can be resiliently biased together, each of the furcations terminating in semi-conical head, the semi-conical heads being positioned in a facing relationship so as to define a split cone which can be resiliently biased together during insertion of the peg through a hole in pegboard;

an engaging means for supporting an object coupled to the mounting means and projecting outwardly therefrom, the engaging means projecting from the lower end of the depending center member outwardly away from said common plane.

* * * * *